US009845598B1

(12) United States Patent
Hsu

(10) Patent No.: US 9,845,598 B1
(45) Date of Patent: Dec. 19, 2017

(54) APPARATUS FOR IMPROVING THE ACOUSTICS OF AN INTERIOR SPACE, A SYSTEM INCORPORATING SAID APPARATUS AND METHOD OF USING SAID APPARATUS

(71) Applicant: Hanson Hsu, Marina Del Ray, CA (US)

(72) Inventor: Hanson Hsu, Marina Del Ray, CA (US)

( * ) Notice: Subject to any disclaimer, the term of this patent is extended or adjusted under 35 U.S.C. 154(b) by 0 days.

(21) Appl. No.: 14/333,723

(22) Filed: Jul. 17, 2014

Related U.S. Application Data

(60) Provisional application No. 62/016,070, filed on Jun. 23, 2014.

(51) Int. Cl.

| | |
|---|---|
| ***G10K 11/28*** | (2006.01) |
| ***E04B 1/99*** | (2006.01) |
| ***E04F 13/075*** | (2006.01) |
| *G10K 11/18* | (2006.01) |
| *E04B 1/82* | (2006.01) |

(52) U.S. Cl.
CPC ..... *E04B 1/99* (2013.01); *E04F 13/075* (2013.01)

(58) Field of Classification Search
CPC ..... E04B 1/99; E04B 1/82; E04B 2001/829; E04F 13/075; G10K 11/18; G10K 11/20; G10K 11/26; G10K 11/28
USPC ..... 181/290, 295, 287, 284
See application file for complete search history.

(56) References Cited

U.S. PATENT DOCUMENTS 1,795,178 A * 3/1931 Messmer ..... E04B 1/99 181/295
1,975,604 A * 10/1934 Hanson ..... E04B 1/994 181/287
2,652,126 A * 9/1953 Mazer ..... E04B 1/8409 181/293
2,935,152 A * 5/1960 Maccaferri ..... E04B 9/001 181/290
3,068,956 A * 12/1962 Cooley ..... F21V 5/02 181/289

(Continued)

FOREIGN PATENT DOCUMENTS

JP 03183862 A * 8/1991

*Primary Examiner* — Edgardo San Martin
(74) *Attorney, Agent, or Firm* — Loeb & Loeb LLP

(57) ABSTRACT

An acoustic panel for use in an interior space is disclosed along with a system and method for using two or more of such panels to improve the acoustics of the interior space. Each acoustic panel comprises a substrate and a plurality of nodules affixed to the substrate wherein each nodule has a width and a substantially right triangular shape across the entire width with a first leg of the right triangular shape substantially perpendicular to the substrate, a base of the right triangular shape substantially parallel to the substrate and a hypotenuse, the first leg of each nodule having a height that is substantially less than a length of a quarter wave formed in the interior space by a lower frequency signal. For any one particular acoustic panel, the nodules are oriented such that their hypotenuse slopes right, left, down or up as determined for each nodule by a predetermined, generally desired direction for redirecting the sound while providing fractal-chaotic differentiality in the portion of the sound waves that are reflected by the acoustic panel.

19 Claims, 17 Drawing Sheets

(56) References Cited

U.S. PATENT DOCUMENTS 3,509,964 A * 5/1970 Eckel ..... E04B 1/84 181/295
3,656,576 A * 4/1972 Gubela ..... E01F 8/007 181/210
3,712,413 A * 1/1973 Eckel ..... E04B 1/8404 181/295
3,735,837 A * 5/1973 Duda ..... E04B 1/84 181/295
4,057,123 A * 11/1977 Erickson ..... E04B 1/8227 160/351
4,064,960 A * 12/1977 Murakami ..... G10K 11/175 181/210
4,114,725 A * 9/1978 Croasdale ..... E04B 1/8227 181/205
4,190,739 A * 2/1980 Torffield ..... H04R 5/02 181/155
4,356,880 A * 11/1982 Downs ..... E04B 1/99 181/286
4,477,505 A * 10/1984 Warnaka ..... G10K 11/16 181/284
4,725,475 A * 2/1988 Fiscus ..... H01Q 1/422 343/872
5,141,073 A * 8/1992 Pelonis ..... E04B 1/8209 181/295
5,160,816 A * 11/1992 Chlop ..... E04B 1/84 181/285
5,317,113 A * 5/1994 Duda ..... E04B 1/84 181/285
5,579,614 A * 12/1996 Dorn ..... E04B 1/84 181/284
5,854,453 A * 12/1998 Fujiwara ..... E01F 8/0058 181/286
5,892,188 A * 4/1999 Hayashi ..... E04B 1/84 181/295
5,975,238 A * 11/1999 Fuchs ..... E04B 1/8209 181/286
5,992,561 A * 11/1999 Holben ..... E04B 1/84 181/295
6,015,026 A * 1/2000 McGrath ..... B32B 5/26 181/286
6,158,176 A * 12/2000 Perdue ..... E04B 1/86 181/284
6,446,751 B1 * 9/2002 Ahuja ..... A47H 23/02 181/280
6,772,859 B2 * 8/2004 D'Antonio ..... E04B 1/84 181/293
6,782,670 B2 * 8/2004 Wendt ..... E04B 9/0478 52/311.1
6,793,037 B1 * 9/2004 Babuke ..... E04B 1/82 181/284
7,565,951 B1 * 7/2009 Perdue ..... E04B 1/86 181/284
7,604,094 B2 * 10/2009 Magyari ..... G10K 11/20 181/286
7,703,575 B2 * 4/2010 Berger, II ..... E04B 9/001 181/286
8,636,104 B2 * 1/2014 Meyer ..... E04B 1/8209 181/286
8,960,367 B1 * 2/2015 Leclerc ..... G10K 11/20 181/286
2003/0006092 A1 * 1/2003 D'Antonio ..... E04B 1/86 181/293
2003/0155176 A1 * 8/2003 Dutton ..... E04B 1/80 181/285
2006/0260870 A1 * 11/2006 Nakagawa ..... E01F 8/0082 181/295
2008/0164094 A1 * 7/2008 Magyari ..... G10K 11/20 181/295
2010/0198426 A1 * 8/2010 Kondo ..... G10K 11/28 700/302
2013/0001011 A1 * 1/2013 Panosh ..... G10K 11/16 181/287
2014/0262607 A1 * 9/2014 Gray ..... E04B 1/84 181/290

* cited by examiner

APPARATUS FOR IMPROVING THE ACOUSTICS OF AN INTERIOR SPACE, A SYSTEM INCORPORATING SAID APPARATUS AND METHOD OF USING SAID APPARATUS

CROSS-REFERENCE TO RELATED APPLICATIONS

This application claims the benefit of, and priority to, U.S. Provisional Application No. 62/016,070, titled "APPARATUS FOR IMPROVING THE ACOUSTICS OF AN INTERIOR SPACE, A SYSTEM INCORPORATING SAID APPARATUS AND METHOD OF USING SAID APPARATUS," filed Jun. 23, 2014. The content of which is hereby incorporated by reference in its entirety.

FIELD OF THE INVENTION

The invention relates to an apparatus for improving the acoustics of an interior space, such as or a sound studio or room in a home, an acoustic system incorporating same and the method of using said apparatus.

BACKGROUND OF THE INVENTION

Sound is vibrations that travel through the air as a mechanical wave of pressure and displacement. Usually, sound refers to only those vibrations at frequencies that are within the range of human perception (generally 20 to 20,000 Hz). The frequency of sound relates to its pitch; the lower the frequency the lower the pitch. Sound waves are generated by a vibrating source (e.g. vocal cords, guitar strings, and an audio speaker diaphragm), which causes the adjacent air to vibrate. As the vibrations travel away from their source, they form a sound wave moving at about 1,125 feet/second.

As sound waves collide with objects, such as walls, the energy in the wave may be absorbed and/or reflected, in whole or in part. The interaction of a surface with sound waves varies according to the texture and structure of the surface. In general, soft, pliable, porous materials like fabric or fiberglass serve as good acoustic absorbers. Conversely, dense, hard, impenetrable materials (e.g. metals) reflect most sound energy. In between, rough materials may be used to scatter the sound energy (i.e. reflect in many directions). The nature of these absorptions, reflections and diffusions are critical to the auditory feel of a space. For example, when a sound wave strikes a flat, hard surface (such as the walls of a room), the sound is reflected in a coherent manner (provided that the dimension of the surface is sufficiently bigger than the wavelength of the incident sound). The sound waves that travel towards the reflecting surface are called the incident sound waves. The sound waves bouncing back from the reflecting surface are called reflected sound waves. In a room with reflecting walls, sound waves are arriving at the listener from a plurality of directions in and out of phase with other copies of the same sound wave. This results in degraded sound quality.

Another problem created indoors is parallel walls and standing waves. Standing waves occur when sound reflects off walls that are opposite each other and a wave equal to the distance between the walls is formed. Like any other sinusoidal wave, standing waves have high points, low points, and nodes. As you move around a room with standing waves you can hear as you walk through these high, low and dead points.

If you had the ability to reconstruct any particular space to improve its acoustic performance you might try to ensure that none of the walls are parallel to one another. However, merely making the walls a few degrees off from parallel is insufficient to fully eradicate standing wave problems. Yet, few spaces can afford the greater than 10 degree difference from parallel required to completely eradicate a standing wave problem. Still further, this non-parallel surface approach would not work well for the floor and ceiling pair.

One could alternatively try to reconstruct some particular space with dimensions that create modes, which would not interfere as much within the audible range. The formula for determining the fundamental frequency of a standing wave between two parallel walls for any particular room dimension is:

$$f=V/d$$

f=Fundamental frequency of the standing wave;
V=Velocity of sound (343 m/sec (1125 feet/sec));
d=dimensions (i.e. length, width, or height) of the room being considered in feet In addition to a standing wave at the fundamental frequency of any room, other standing waves occur at harmonics of the fundamental frequency—that is 2, 3, and 4 times the fundamental frequency. So, for example, the foregoing equation shows that a 20 foot long room will cause resonances at the fundamental frequency of 56.25 Hz, as well as at, at least, 112.5 Hz, 168.75 Hz, 225 Hz, etc. These 'resonant modes' cause large peaks and dips in audible response, which begins for humans at as low at 20 Hz.

Previously, audio engineers would try to add absorbent materials to an interior space to dampen these resonant modes. Absorbent materials merely decrease the amplitude of any acoustical anomalies, characteristics or other issues. The sound energy absorbed by the absorbent materials (or any other physical object within the space, for that matter) is transformed into heat and is said to have been "lost." In particular, absorption is thought to occur through friction of the air motion against individual fibers of the absorbent materials with the resulting kinetic energy being converted to heat. Thus, the amount of sound energy lost is a function of frequency of the sound and the incident angle as well as the acoustic impedances of the air and of the object(s) involved in the absorption. Accordingly, the density of the absorbent material matters to the results. If the material is too loose sound will pass through practically unchanged, but too firm and reflection will occur. In addition, a layer of absorbent material has to be of the order of a quarter-wavelength thick in order to be effective. At low frequencies with their long wavelengths (i.e. the wavelength of a 20 Hz sound is nearly 60 feet) this requires a very thick layer of absorbent material.

Glass fibers are often used for absorption because of its useful physical properties. However, even six inches of glass fiber has little effect at 100 Hz, where a quarter wavelength is nearly 3 feet (i.e. 1125 feet per second/100 Hz). The effectiveness of glass fibers can improve above 100 Hz (the upper bass region) where 1 kHz has a quarter wave on the order of mere inches. Do-it-yourselfers sometimes use curtains and carpets for their allegedly absorptive properties to improve the sound quality in a room. However, these materials are really only effective for sound at frequencies above 5 kHz.

In addition to simple absorbent materials, various apparatuses to improve the acoustics of an interior space are known. Generally, these apparatuses have attempted to improve acoustics by controlling the sound wave absorption and reflection within the room by modifying the surfaces (e.g. walls and ceiling) of the interior space. For instance, audio engineers have added saw-toothed walls, sloping walls, multi-planar speaker soffits, bass traps, suspended clouds, Helmholtz resonators, quadratic diffusors, and the like to studios in an effort to achieve better acoustics. Even with these solutions, artists, producers and engineers alike were reduced to sharing a one-foot square sweet spot in even the most prestigious studio facilities. And worse, imaging, clarity, and realism still often lose out to economics and/or aesthetics. (Sweet spot is the position in the room where the audio sounds the best. Typically, a one foot cube at the mix position where frequency, amplitude and timber are as close to evenly balanced as possible.)

Thus, there is a need for apparatuses that improve the imaging, clarity, and realism of an interior space that are economical and aesthetically pleasing. There is an associated need for apparatuses that can be deployed in every home, office, theatre, store, plane, train and automobile to improve the acoustic properties of each of those spaces.

These and other objects and advantages of the present disclosure will also be apparent to those of ordinary skill in the art having the present drawings, specifications, and claims before them. It is intended that all such additional systems, methods, features, and advantages be included within this description, be within the scope of the disclosure, and be protected by the accompanying claims.

BRIEF SUMMARY OF THE INVENTION

The disclosed subject matter relates, in part, to an acoustic panel for use in an interior space. The disclosed acoustic panel comprises a substrate and a plurality of nodules affixed to the substrate. Each of the nodules has a width and a substantially right triangular shape across the entire width with a first leg of the right triangular shape substantially perpendicular to the substrate, a base of the right triangular shape substantially parallel to the substrate and a hypotenuse. Each may preferably be made of wood. The first leg of each nodule has a height that is substantially less than a length of an audio quarter wave that is contemplated to be formed in the interior space by a lower frequency signal. Each of the nodules are oriented on the face of the substrate such that the hypotenuse slopes right, left, down or up as determined for each nodule by a predetermined, generally desired direction for redirecting the sound while providing fractal-chaotic differentiality. The acoustic panel may further including a sound absorption layer located on top of substantially all of the plurality of nodules. This sound absorption layer may be acoustically transparent. The layer may be less than about 0.5 inches thick and may be formed of natural fibers.

The acoustic panel may still further include a frame configured to receive the substrate and the plurality of nodules as well as a sound absorption layer, where such layer is included, substantially within the three-dimensional area circumscribed by the frame. A sheet of fabric may be wrapped over the frame in some embodiments. The fabric sheet may be acoustically transparent. Still further, a hanger may be operably connected to the substrate, the hanger being configured to support the acoustic panel on a pre-existing surface of the interior space.

Of course, while other variables such as the topology of the interior space, its acoustic structure, surface geometries, materials, etc., may affect acoustic resolution and quality of the space, the novel acoustic panels dramatically increase acoustic resolution from 7,000 to nearly 15,000 times that of even sound studios professionally-designed using traditional methodology. In the context of the present invention and disclosure, acoustic resolution is to DSP resolution what non-parallel surfaces are to DSP sampling rates, wherein it is commonly said in the audio industry that the improvements in both clarity and imaging created by quadrupling sampling rates (i.e. 48 kHz to 192 kHz) is conservatively rated as a 100% increase by industry professionals. Accordingly, the novel acoustic panels create spaces that possess lifelike aural imaging with a nearly wall-to-wall sweet spot and zero bass traps. More remarkably these results are achieved with acoustic panels that may be no thicker than ¾" to 1¼".

The disclosed subject matter relates, in another part, to a system for improving the acoustics of an interior room. The system comprises first and second acoustic panels. The first acoustic panel has a first substrate and a first plurality of nodules affixed to the first substrate. Each of the nodules of the first acoustic panel has a width and a substantially right triangular shape across the entire width with a first leg of the right triangular shape substantially perpendicular to the first substrate, a base of the right triangular shape substantially parallel to the first substrate and a hypotenuse. The first leg of each nodule has a height that is substantially less than a length of an audio quarter wave that is contemplated to be formed in the interior space by a lower frequency signal. Each of the nodules are oriented on the face of the first substrate such that the hypotenuse slopes right, left, down or up as determined for each nodule by a predetermined, generally desired direction for redirecting the sound while providing fractal-chaotic differentiality. That predetermined, generally desired direction for the first acoustic panel may be away from the listening zone and may even be toward a first one of one or more dead zones in the interior room. The predetermined, generally desired direction for the first acoustic panel may be directed generally toward a second acoustic panel.

The second acoustic panel has a second substrate and a second plurality of nodules affixed to the second substrate. Each of the nodules of the second acoustic panel has a width and a substantially right triangular shape across the entire width with a first leg of the right triangular shape substantially perpendicular to the second substrate, a base of the right triangular shape substantially parallel to the first substrate and a hypotenuse. The first leg of each nodule has a height that is substantially less than a length of an audio quarter wave that is contemplated to be formed in the interior space by a lower frequency signal. Each of the nodules are oriented on the face of the second substrate such that the hypotenuse slopes right, left, down or up as determined for each nodule by a predetermined, generally desired direction for redirecting the sound while providing fractal-chaotic differentiality. That predetermined, generally desired direction for the second acoustic panel may even be toward a second one of one or more dead zones in the interior room.

The system may further include a third acoustic panel wherein the predetermined, generally desired direction for the second acoustic panel is directed generally toward the third acoustic panel.

The disclosed subject matter further relates, in another part, to a method of improving the acoustics of an interior room. The method comprises installing a first acoustic panel having a first substrate and a first plurality of nodules affixed to the first substrate. Each of the nodules has a width and a substantially right triangular shape across the entire width with its first leg substantially perpendicular to the first substrate, the base substantially parallel to the first substrate and a hypotenuse. The first leg of each nodule has a height that is substantially less than a length of an audio quarter wave that could be formed in the interior space by a lower frequency signal. Each of the nodules are oriented on the face of the first substrate such that the hypotenuse slopes right, left, down or up as determined for each nodule by a predetermined, generally desired direction for redirecting the sound while providing fractal-chaotic differentiality. The method further comprises installing a second acoustic panel having a second substrate and a second plurality of nodules affixed to the second substrate. Each of the nodules has a width and a substantially right triangular shape across the entire width with its first leg substantially perpendicular to the second substrate, the base substantially parallel to the second substrate and a hypotenuse. The first leg of each nodule has a height that is substantially less than a length of an audio quarter wave that could be formed in the interior space by a lower frequency signal. Each of the nodules are oriented on the face of the second substrate such that the hypotenuse slopes right, left, down or up as determined for each nodule by a predetermined, generally desired direction for redirecting the sound while providing fractal-chaotic differentiality. The method may further comprise adjusting one or both of the first and second acoustic panels such that the sound waves that reach the first acoustic panel are at least partially redirected to reach the second acoustic panel while providing pseudo-chaotic differentiality.

Other systems, methods, features, and advantages of the present invention will be or will become apparent to one with skill in the art upon examination of the following figures and detailed description. All such additional systems, methods, features, and advantages are included within this description, are within the scope of the invention, and are protected by the accompanying claims. Accordingly, the present invention is not restricted except in light of the attached claims and their equivalents.

BRIEF DESCRIPTION OF THE FIGURES

For a better understanding of the present disclosure, non-limiting and non-exhaustive embodiments are described in reference to the following drawings. In the drawings, like reference numerals refer to like parts through all the various figures unless otherwise specified.

DETAILED DESCRIPTION OF THE INVENTION

Figure 1:
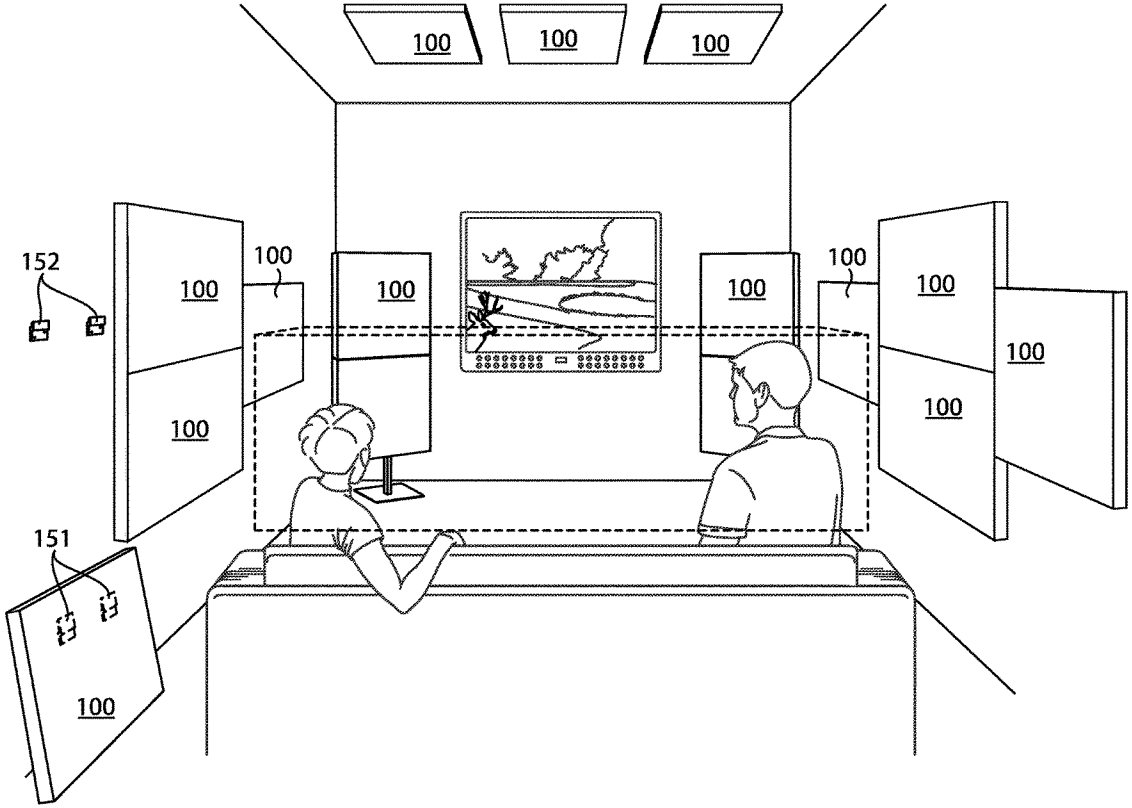
FIG. 1 illustrates a plan view of an interior space with a plurality of acoustic panels 100 deployed.

FIG. 1 illustrates a plan view of an interior space with a plurality of acoustic panels 100 deployed. The exemplary interior space depicted in FIG. 1 is a room with four walls, a floor and a ceiling with a television (or other audio source) mounted on the front wall of the interior space. A rectangle formed by dotted lines hovers about the two people sitting on the couch toward the back of the interior space indicates a listening zone in the illustrated interior space. The interior space may also have dead zones where it would be unlikely to find any listener in the space. For instance, in the example of FIG. 1 near the floor beneath the television set at the front of the interior space would likely be a dead zone. One or more acoustic panels 100 may be deployed as various positions in the interior space to improve the acoustical performance of the interior space. In the example of FIG. 1, the panels are mounted on at least left and right walls, as well as the ceiling of the interior space. Two pairs of acoustic panels 100 are also illustrated on stands on either side of the wall mounted television set. As would be understood by those of skill in the art having the present specification before them, acoustic panels may also be deployed on portions of the back wall of the interior space (not shown).

As shown in the lower left-hand corner of FIG. 1, the acoustic panel 100 may also include a hanger clip 151 operably connected to the substrate. The hanger clips 151 being configured to support the acoustic panel 100 on a pre-existing surface of the interior space wherein the hanger is physically connected to the frame. In a preferred embodiment, hanger clips 151 interact with a respective wall bracket 152, which is preferably mounted on the pre-existing surface. As shown in FIG. 1, the preferred lengths of hanger clips 151 and wall bracket 152 along with their ability to slide relative to one another allows for each acoustic panel 100 to be horizontally adjusted at or after the time of installation to provide some level of acoustic calibration for the interior room.

Figure 2:
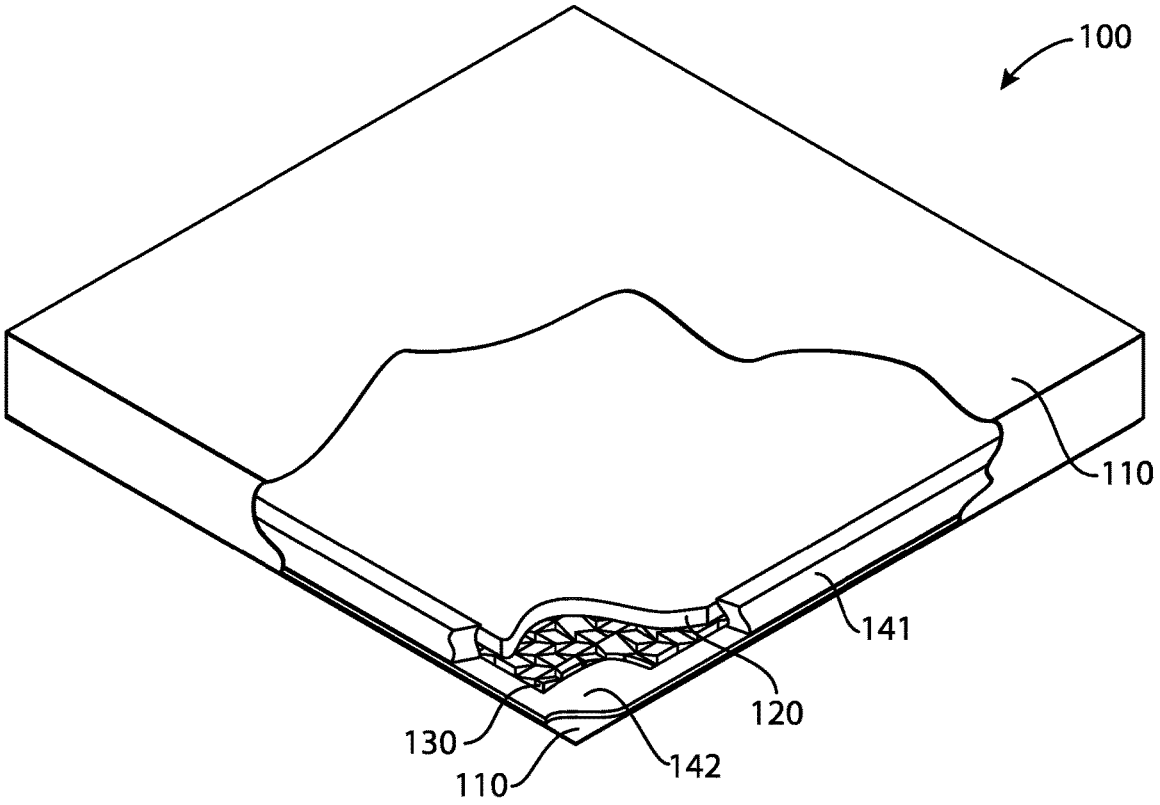
FIG. 2 illustrates a partial cut away, cross-sectional view of one embodiment of acoustic panel 100.

FIG. 2 further illustrates one embodiment of acoustic panels 100 in a partial cut away, cross-sectional view. In particular, FIG. 2 illustrates an acoustic panel having a fabric sheet 110 wrapped over a sound absorption layer 120, a frame 141, a substrate 142 and a plurality of nodules 130 affixed to the substrate. While the substrate may be made of a flexible material, as shown in FIG. 2, the frame 141 may be configured to receive the substrate 142, sound absorption layer 120, and the plurality of nodules 130 within the three-dimensional area circumscribed by the frame. The frame may be made of plywood and may have the following dimensions: 24" (L) by 22.5" (W), and ⅞" (H).

The fabric sheet 110 may be acoustically transparent. In particular, the fabric may be 10-14 oz. per linear yard with an ASTM C423-90A acoustical rating and ASTM E-84 (unadhered) Class A flame resistance. Sheet 110 may be adhered to the panel using mechanical fasteners, such as staples (e.g. Arrow 505IP 5/16").

The sound absorption layer 120 may be located on top of substantially all of the plurality of nodules 130. The sound absorption layer is preferably less than about 0.5 inches thick and acoustically transparent. The sound absorption layer may be formed of natural fibers. In one approach the sound absorption layer may be made from Quiet-Liner™ insulation, a thermally bonded insulation made from recycled acoustical cotton used primarily as an acoustical liner designed for equipment enclosures, HVAC, large volume ceilings, walls and corrugated metal ceilings to absorb unwanted noise.

As will be understood by those of ordinary skill in the art having the present specification, drawings, and claims before them, it would be possible to enjoy many of the benefits of the present invention without the fabric sheet 110, the sound absorption layer 120, and the frame 141. It is believed that the plurality of nodules 130 provides substantially all of the extreme acoustic resolution of the acoustic panel 100 that allows the invention to overcome the threshold between geometry and mass, resulting in high phase coherency, three-dimensional aural imaging and definition.

Figure 3A:
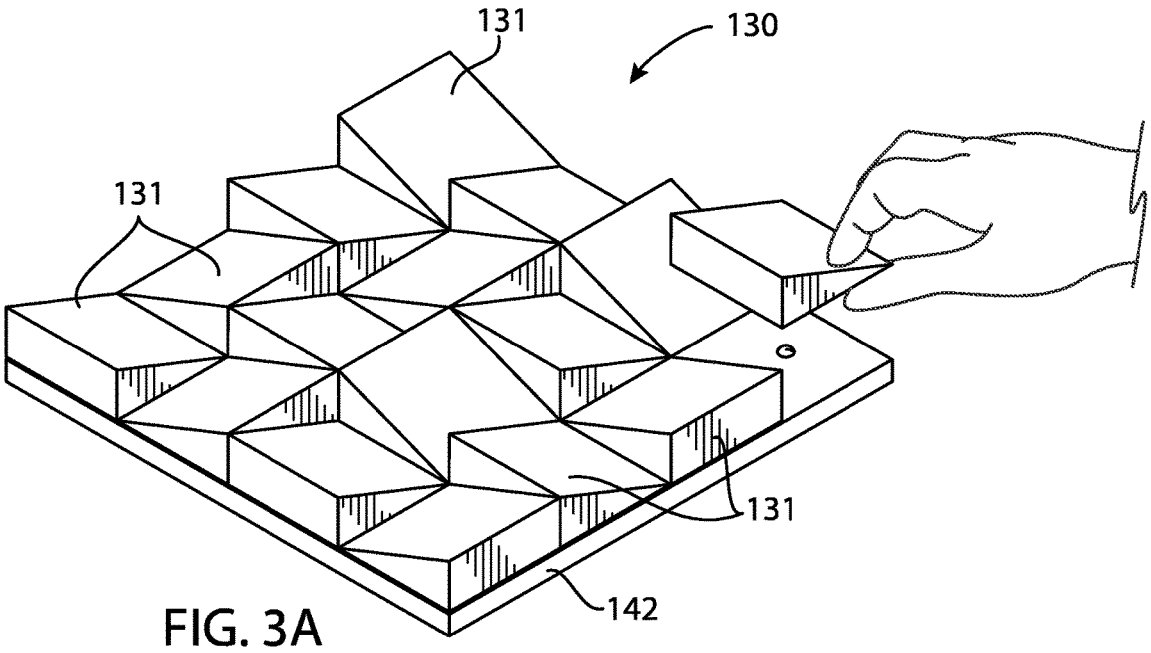
FIG. 3A illustrates a perspective elevational view of a plurality of nodules affixed to a substrate.
Figure 3B:
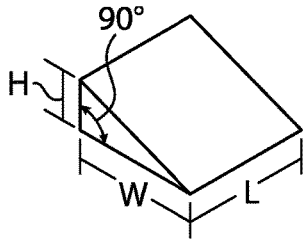
FIG. 3B illustrates a plan view of a single nodule 131.
Figure 4:
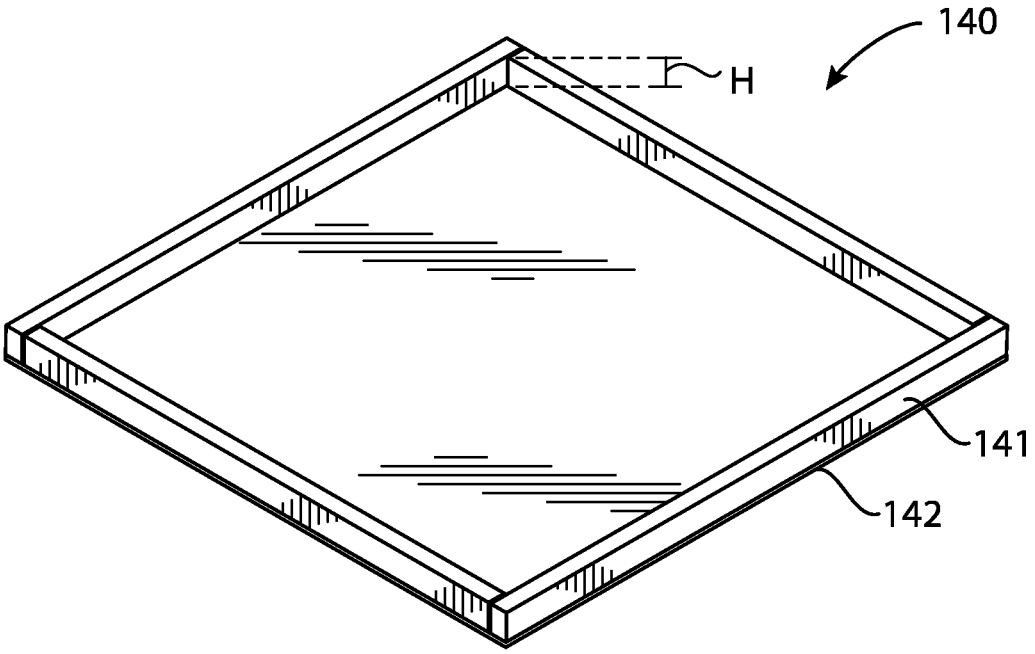
FIG. 4 illustrates a perspective view of a frame that may be used in an embodiment of an acoustic panel.
Figure 5A:
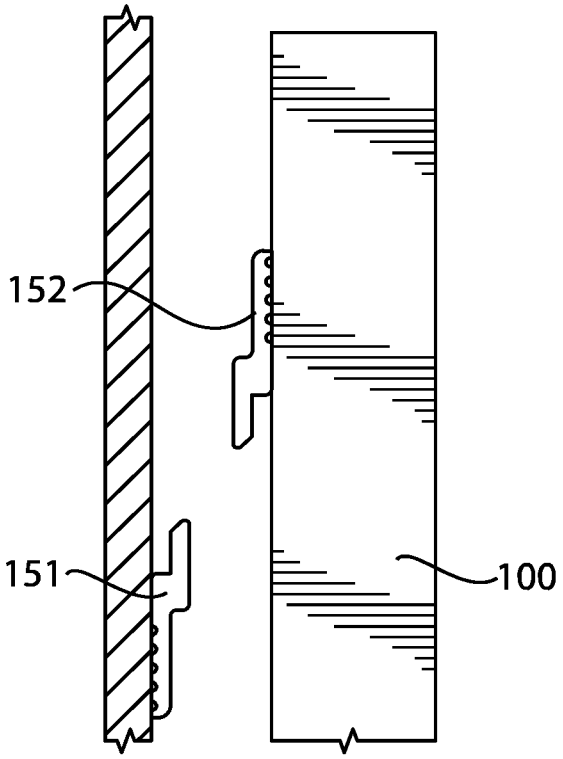
FIGS. 5A and 5B are side elevational partial cross-sectional views, which together illustrate one approach to mounting an acoustic panel to a vertical pre-existing surface, such as a wall.
Figure 5B:
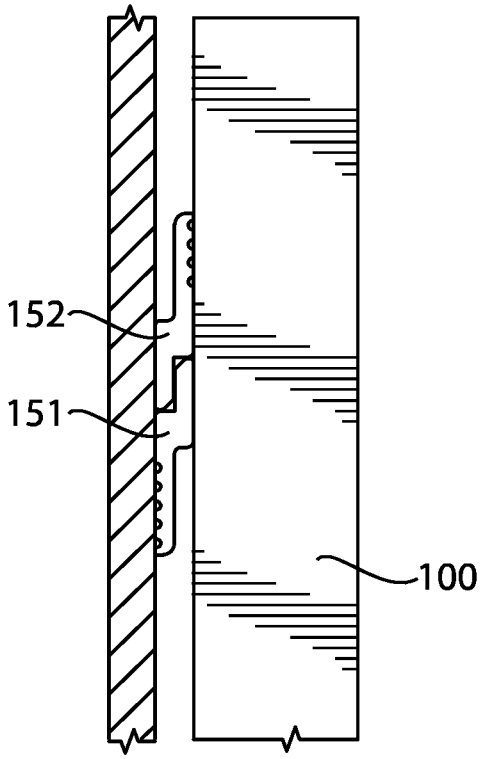
Figure 6A:
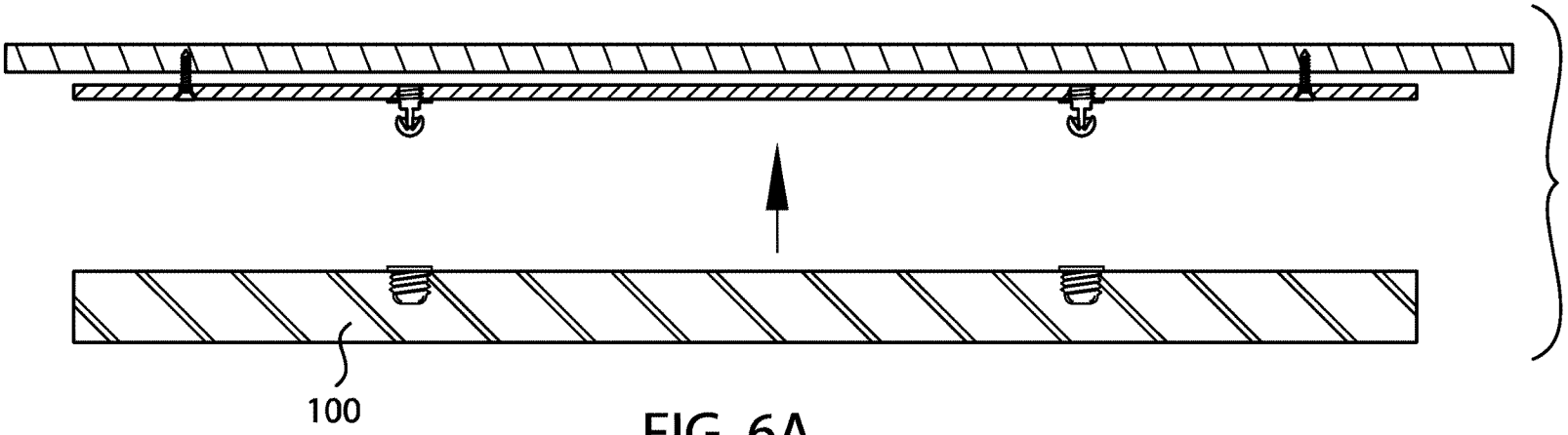
FIGS. 6A and 6B are side elevational partial cross-sectional views, which together illustrates one approach to mounting an acoustic panel to a horizontal pre-existing surface, such as a ceiling.
Figure 6B:
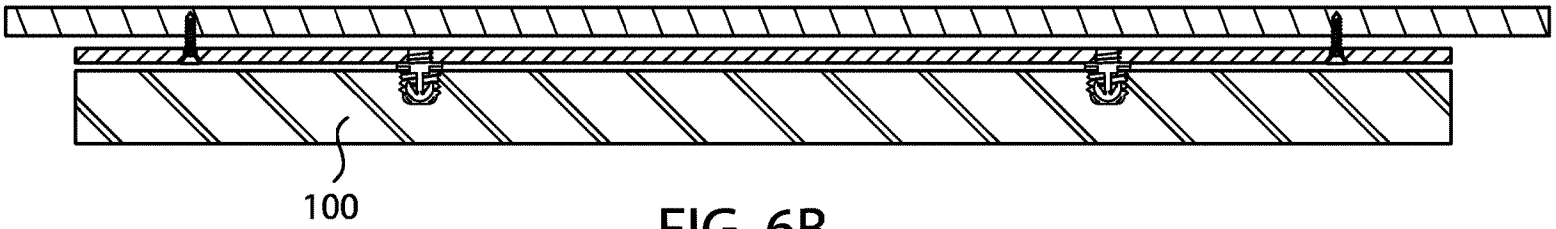
Figure 7:
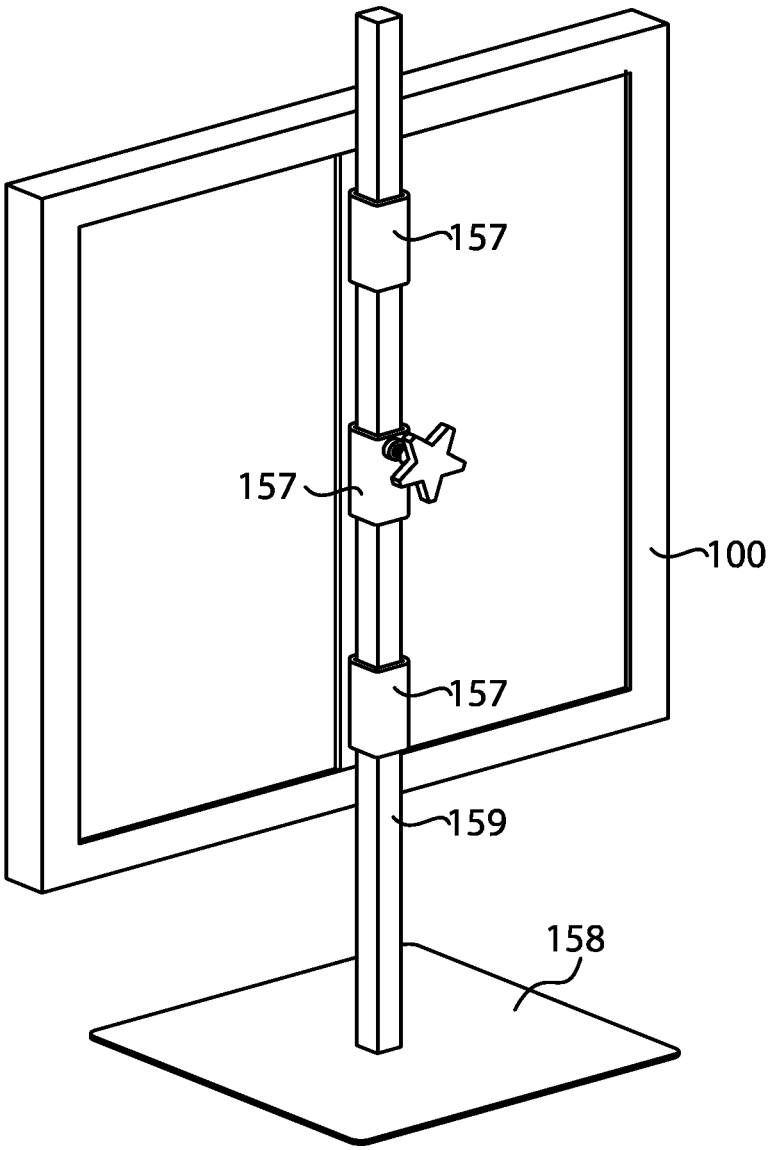
FIG. 7 illustrates a rear perspective view of one embodiment of a stand mount support for an acoustic panel.

FIG. 3A illustrates a perspective elevational view of a portion of the plurality of nodules 130 affixed to the substrate 142 showing, in particular, one potential relationship of individual nodules 131 to one another. The nodules may be individually fabricated and attached to the substrate 142 using a bead of adhesive. As would be understood, a line of adhesive could be used instead to adhere a line of nodules. The nodules may be made of wood, such as birch plywood. As shown in FIG. 3B each nodule 131 has a substantially right triangular shape across its entire width, W. As illustrated, each nodule 131 also has a substantially constant width, W, length, L, and height, H. In one embodiment, the dimensions of the nodule may be 15/16" (L), 15/16" (W), ⅜" (H). As illustrated with reference to FIG. 3A, a first leg of each right triangular shaped nodule 131 is substantially perpendicular to a face of the substrate 142 and a base of each right triangular shaped nodule is substantially parallel to the substrate 142. The first leg of each nodule defines the height of the nodule. It is contemplated that the width, length and height will be substantially identical for each and every nodule in any particular acoustic panel. However, there is no particular requirement that the nodules be any special width, length or height. Still, the present invention permits the height of the nodules to be substantially less than a length of a quarter wave formed in the interior space by a lower frequency signal yet still provide an improvement in the acoustics of the interior space.

As shown in FIG. 3A, each of the nodules 131 are oriented on the face of the substrate 142 such that their hypotenuse slopes right, left, down or up. In the context of FIG. 3A, the terms "right", "left", "down", and "up" are directions relative to each other. As will be discussed with reference to FIGS. 8A through 8J, these relative directions take on particular relative meaning as the particular orientation of each nodule 131 in the plurality of nodules in each acoustic panel 100 is essentially determined by a predetermined, generally desired direction for redirecting sound while providing fractal-chaotic differentiality.

In the context of the present application, "fractal-chaotic differentiality" refers to the concept having scalability akin to fractal geometry combined with the specific randomness of a quasi-chaotic system. By orienting each nodule 131 in the plurality of nodules with a goal of fractal-chaotic differentiality, the present invention controls the air interacting with the plurality nodules at a molecular level.

Nearly all sound sources produce complex waveforms made up of a multitude of simple waveforms each with their own frequency, amplitude and phase. Using a combination of absorption, diffusion, and quantization the panel 100 improves the acoustics of an interior room by not allowing sound to come back to the listening zone of the interior space (illustrated in FIG. 1 by the rectangular dotted lines hovering about the two people sitting on the couch). In particular, quantization occurs when the panel is close enough to the sound source (i.e. a distance of less than one duty cycle away) and diffusion occurs when the panel is greater than one duty cycle away from the sound source. Thus, the plurality of individual air molecules on which the sound waves are carried are redirected by the plurality of nodules with a quasi-chaotic pattern. In other words, the goal of fractal-chaotic differentiality is to control sound by controlling the medium on which sound travels (i.e. air) before audio modulation can occur.

By commencing the design of an acoustic panel 100 with a high degree of fractal-chaotic differentiation expecting an exponential level of change over the course of time (e.g. chaos math) the present invention achieves its goal of improved acoustics. The predetermined, generally desired direction for redirecting sound provides some counter to the goal of chaotic response. The idea behind redirecting sound in a predetermined, generally desired direction is to direct sound waves reflecting off of the panels 100 generally away from the listening zone of the interior space (illustrated in FIG. 1 by the rectangular dotted lines hovering about the two people sitting on the couch) and/or towards one of the dead zones in the space. It would be more preferable for the sweet spot to be six feet wide, two feet off the ground up to six feet, six inches off the ground and span the entire length of the room, which may be achieved with the panels 100 of the present invention.

By orienting more nodules 131 within the plurality of nodules in a particular direction (i.e. up, down, right or left) than fractal-chaotic differentiality would dictate, an acoustic panel 100 can be used to direct sound wave in a general direction. For example, a nodule 131—that slopes right (i.e. down to its right) would be expected to direct any sound wave that reflects off its face to the right of the acoustic panel (as perceived by one facing the panel). One such nodule rightward reflecting nodule is illustrated at position A1 of panel 160 (FIG. 8A).

Figure 8A:
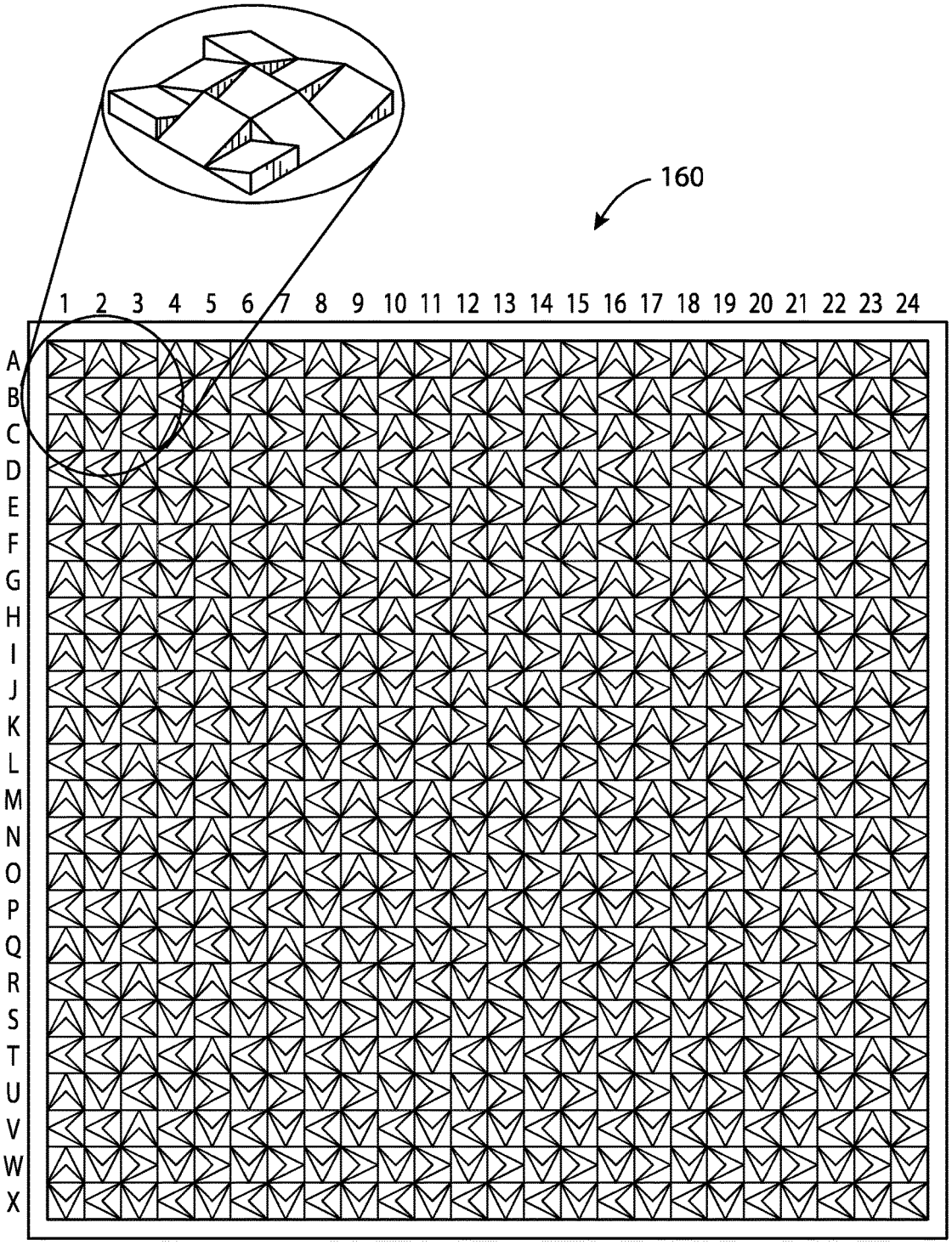
FIG. 8A is a schematic plan view of one embodiment of an acoustic panel 160 with an inset illustrating the meaning of the chevron patterns on the schematic.

The best way to explain the effect of a predetermined, generally desired direction for redirecting the sound while providing fractal-chaotic differentiality is to look at the illustrative designs depicted in FIGS. 8A through 8J. To assist in this explanation, FIG. 8A includes an inset that illustrates the meaning of the chevron patterns (used to indicate the downward slope of the nodules) in FIGS. 8A through 8J. In particular the chevrons indicate the direction of the downward slope of each nodule. In FIG. 8A, nodule A1 slopes downward from left to right; nodule A2 slopes from bottom to the top; nodule A3 slopes from left to right; nodule B1 slopes from right to left; nodule B2 slopes from right to left; nodule B3 slopes from bottom to top; nodule C1 slopes from bottom to top; nodule C2 slopes from top to bottom; and nodule C3 slopes from right to left.

In addition to the effect of designing a predetermined, generally desired direction for redirecting sound has on the goal of fractal-chaotic differentiality, the examples in FIGS. 8A through 8J, illustrate a variety of acoustical exceptions to a pure fractal-chaotic orientation. For instance, it has been found to be undesirable to have adjacent nodules 131 face each other. Said differently, in positioning nodules, an acoustical engineer should preferably not place a left-facing nodule to the adjacent left of a right-facing nodule as such placement would effectively create a valley between adjacent nodules. The same concern arises between adjacent upward and downward facing nodules. The preference for avoiding such configurations does not mean that the present invention absolutely precludes the existence of such valleys (see, e.g., nodules 12C and 13C in FIG. 8C and nodules 21W and 21X in FIG. 8G).

As another exemplary exception to the chaotic orientation of the nodules 131, it has been found to be less desirable to reflect sound waves into the corners of the panels 100 particularly in embodiments that use a frame 141. Consequently, the design should preferably avoid such designs, however, this preference does not mean the present invention absolutely preclude the existence of such placements.

Figure 8B:
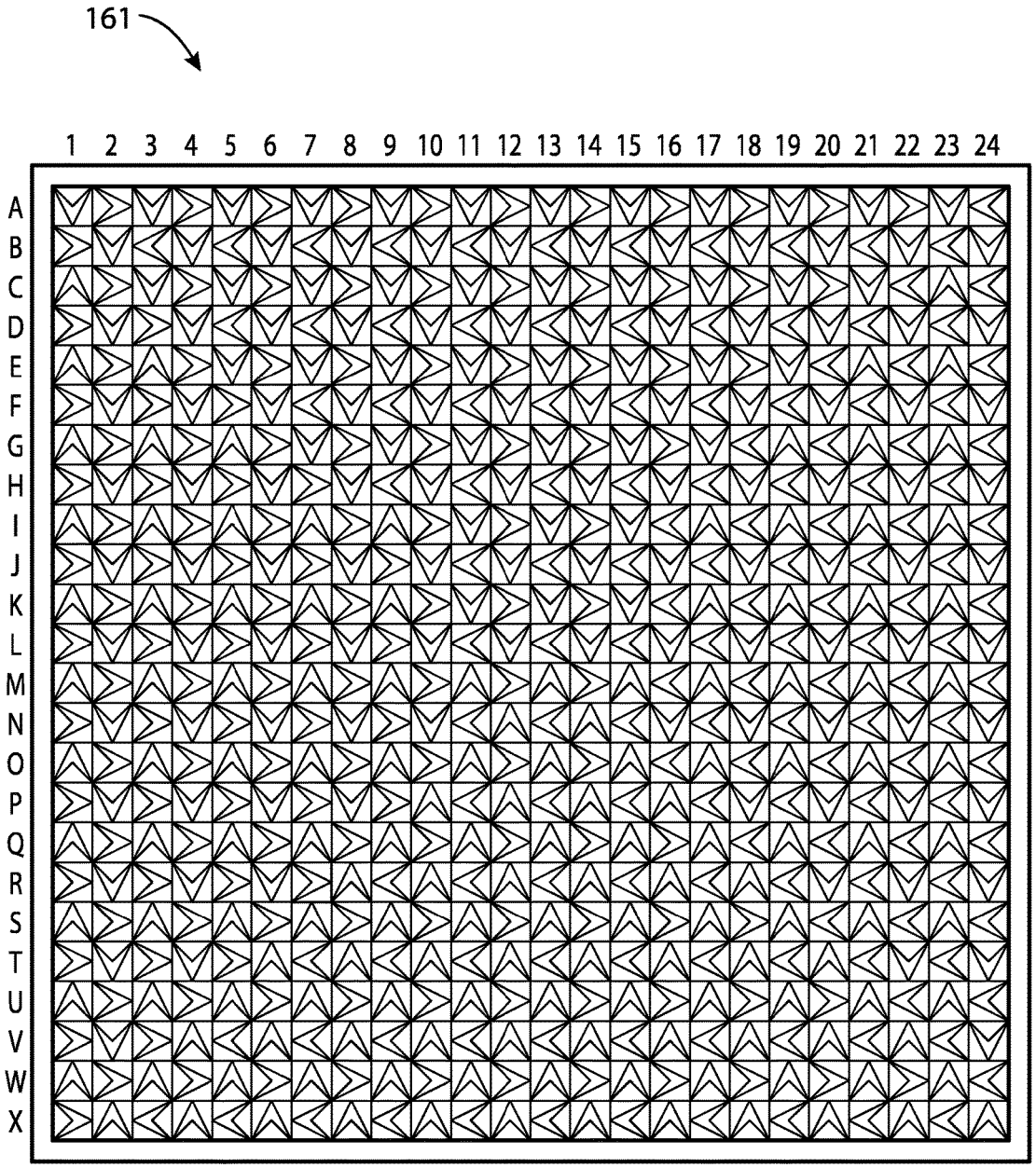
FIG. 8B is a schematic plan view of an acoustic panel 161.
Figure 8C:
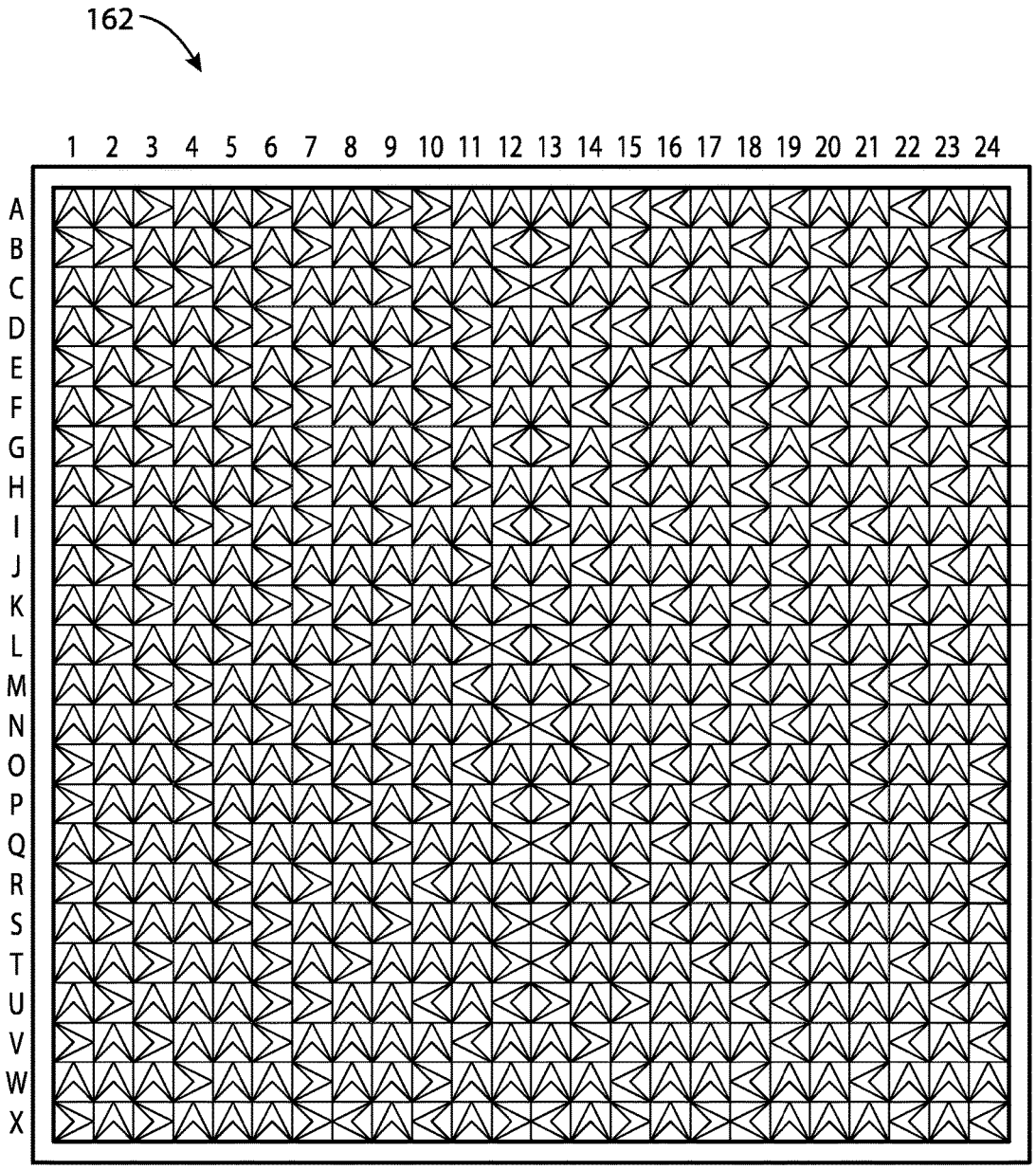
FIG. 8C illustrates a schematic plan view of an acoustic panel 162.
Figure 8D:
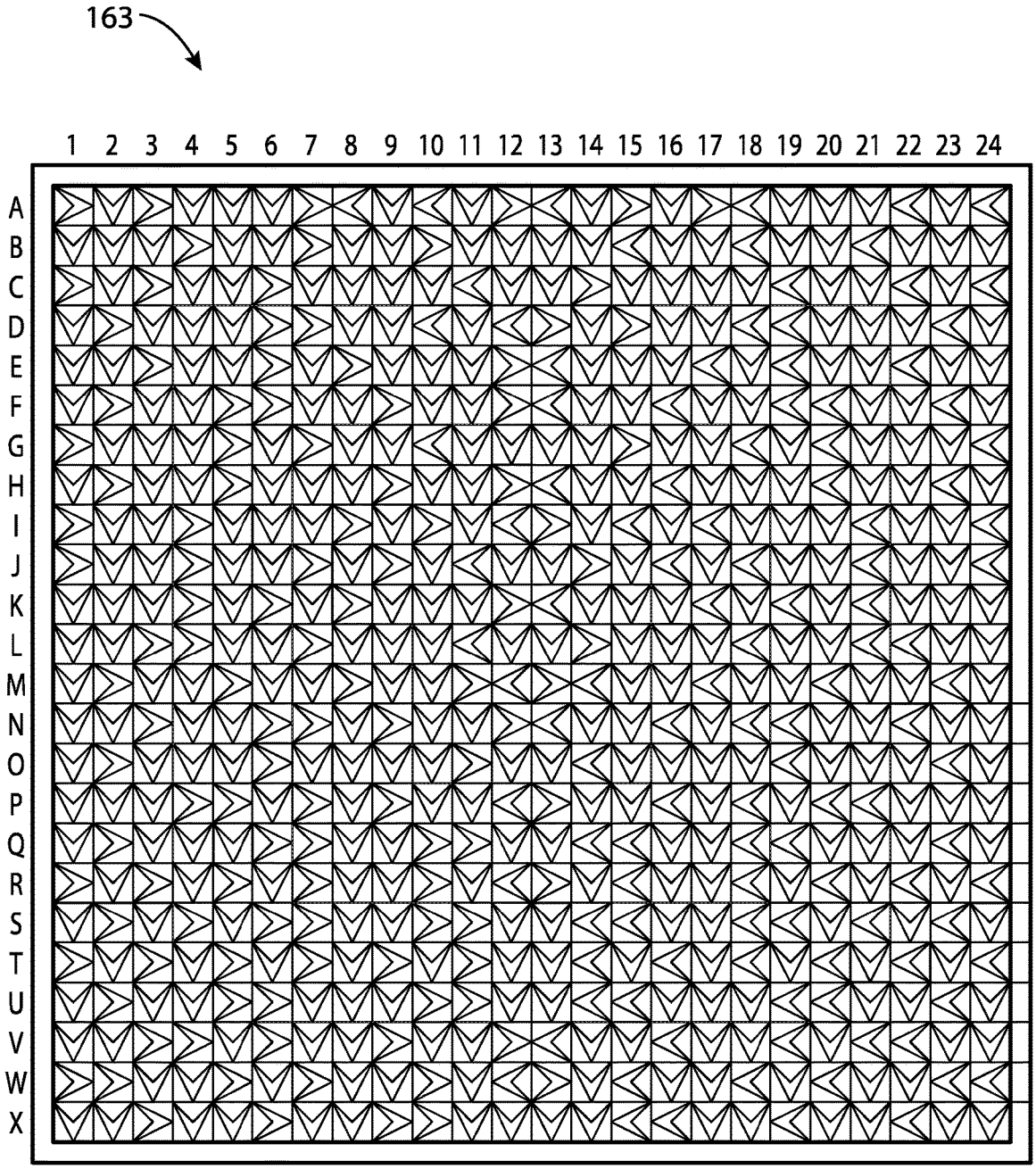
FIG. 8D illustrates a schematic plan view of an acoustic panel 163.
Figure 8E:
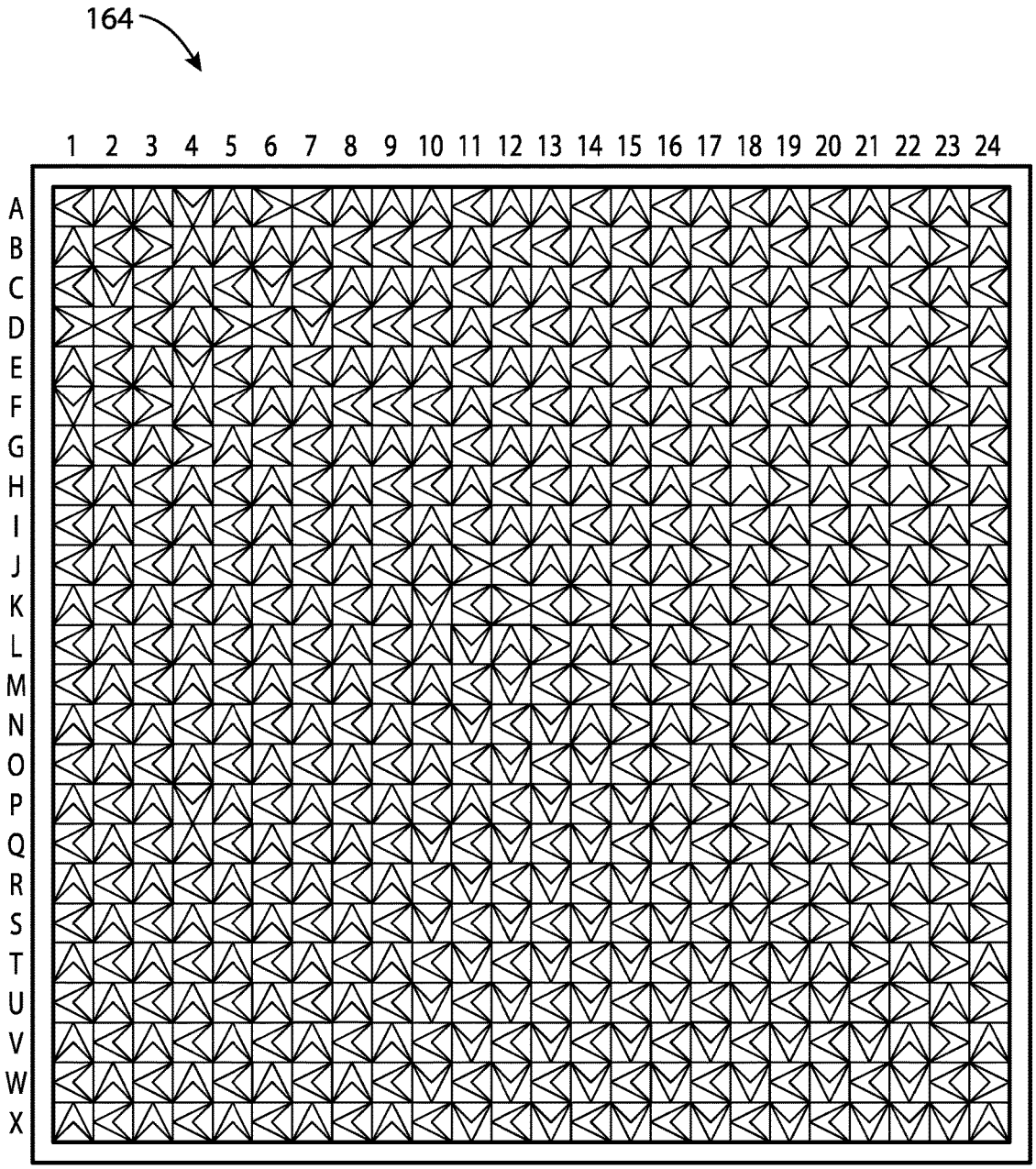
FIG. 8E illustrates a schematic plan view of an acoustic panel 164.
Figure 8F:
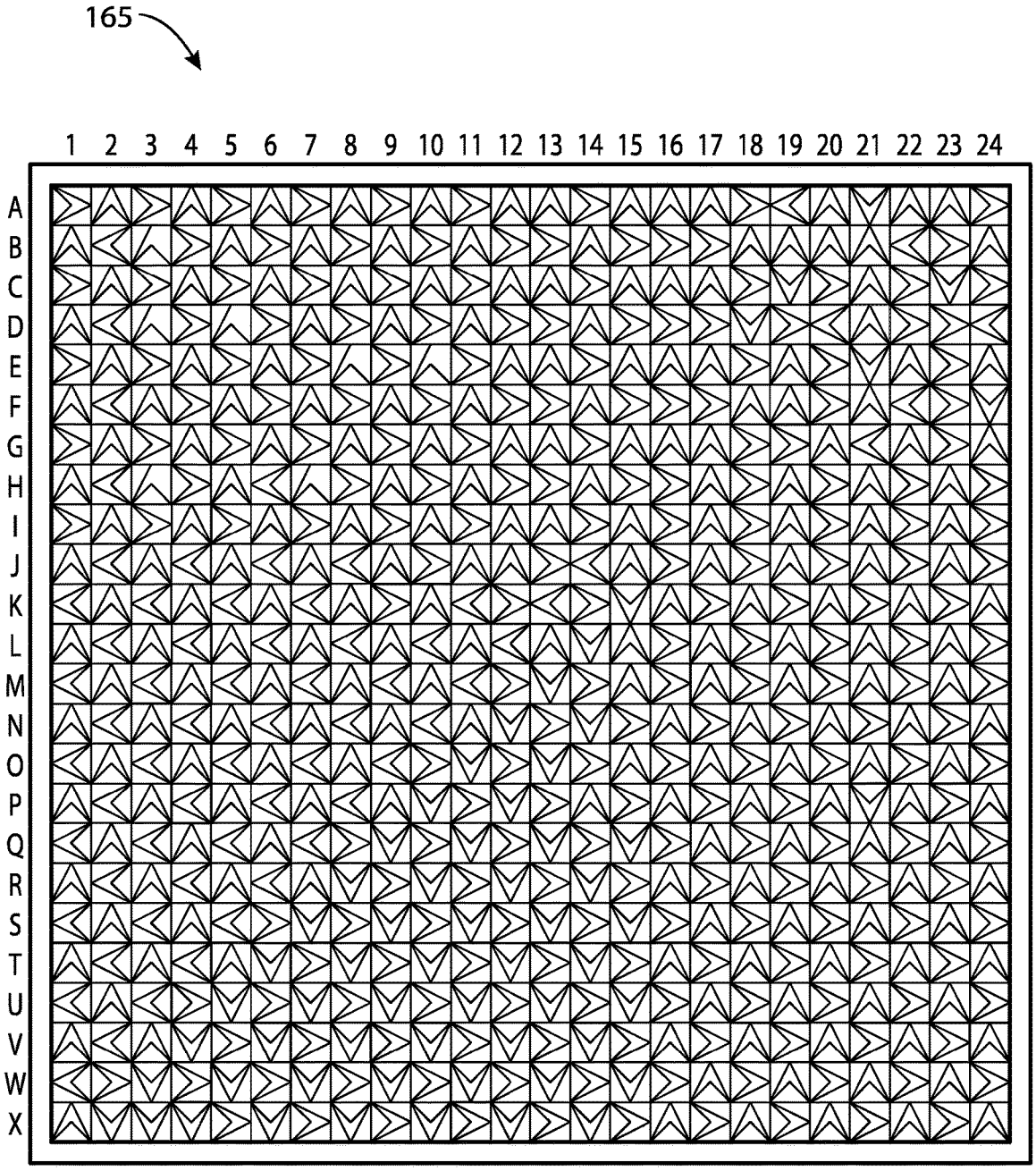
FIG. 8F illustrates a schematic plan view of an acoustic panel 165.
Figure 8G:
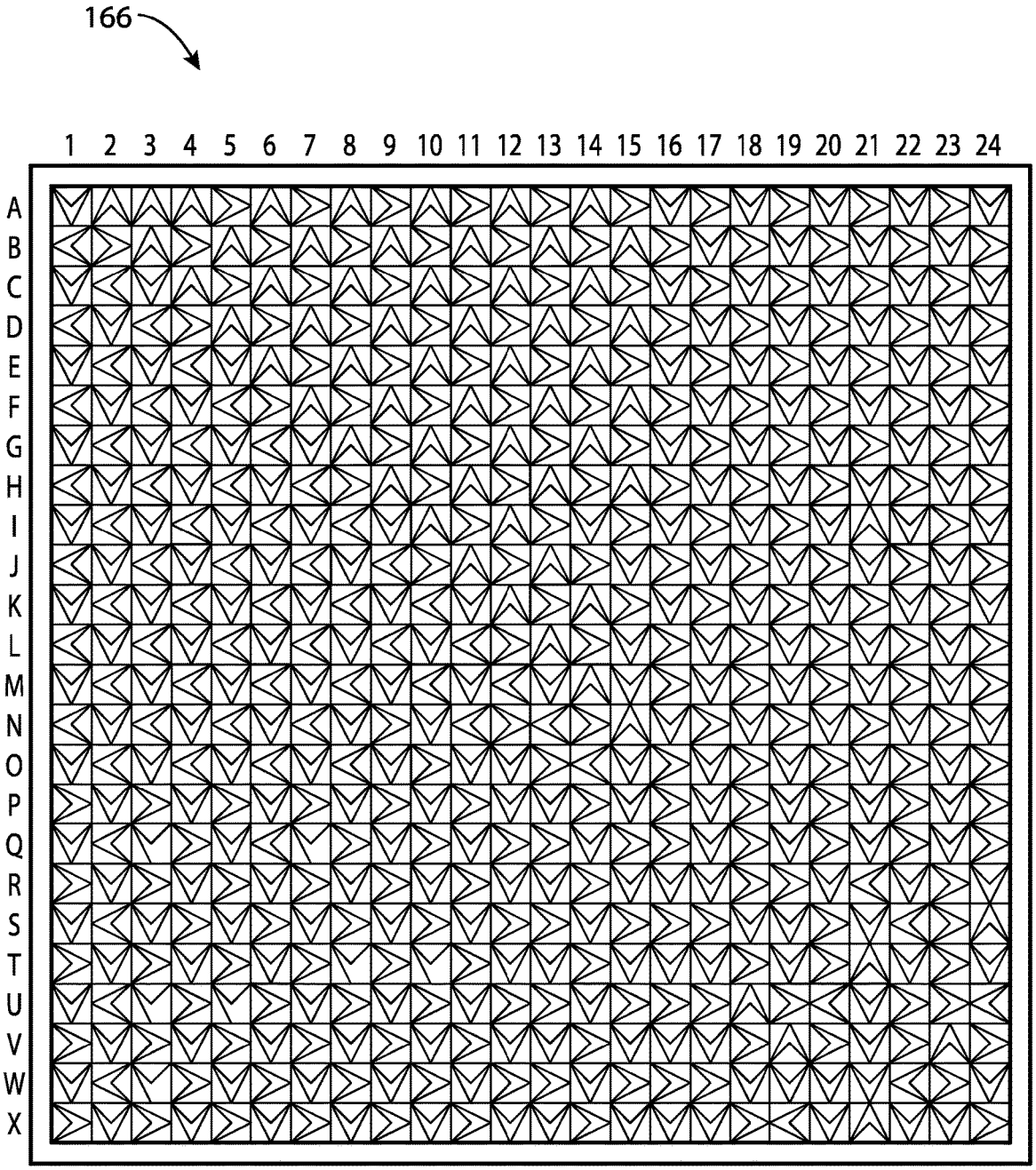
FIG. 8G illustrates a schematic plan view of an acoustic panel 166.
Figure 8H:
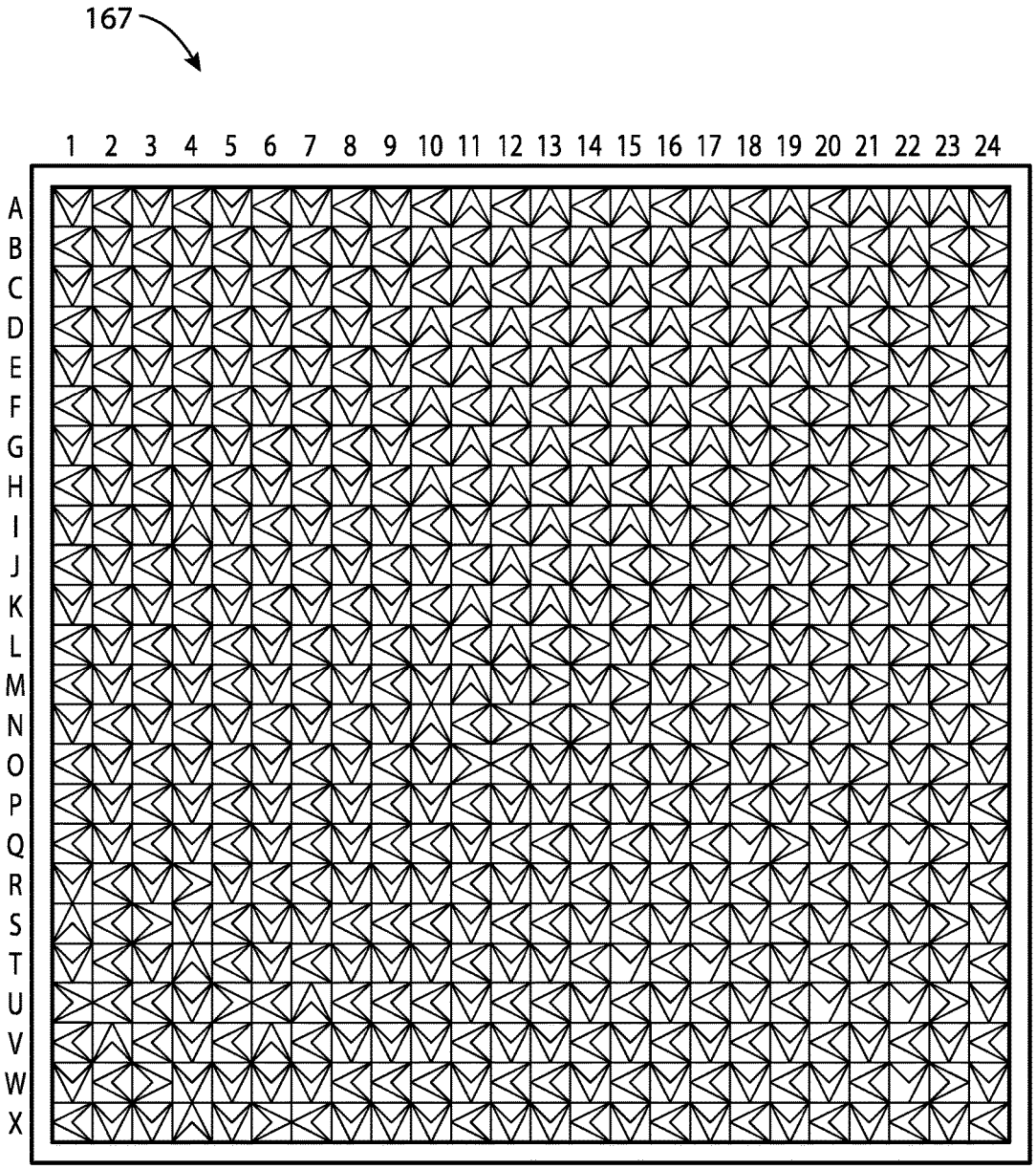
FIG. 8H illustrates a schematic plan view of an acoustic panel 167.
Figure 8I:
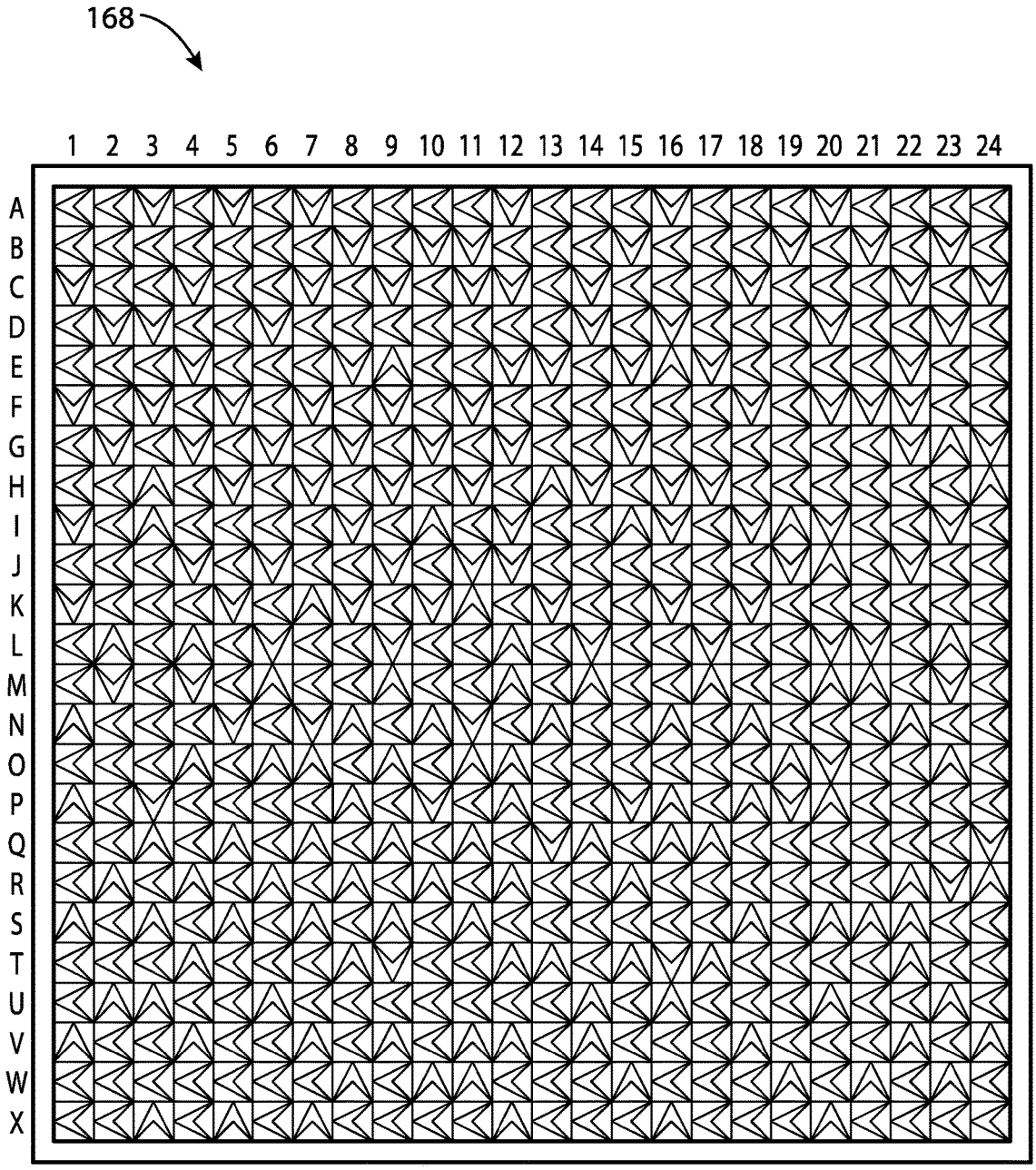
FIG. 8I illustrates a schematic plan view of an acoustic panel 168.
Figure 8J:
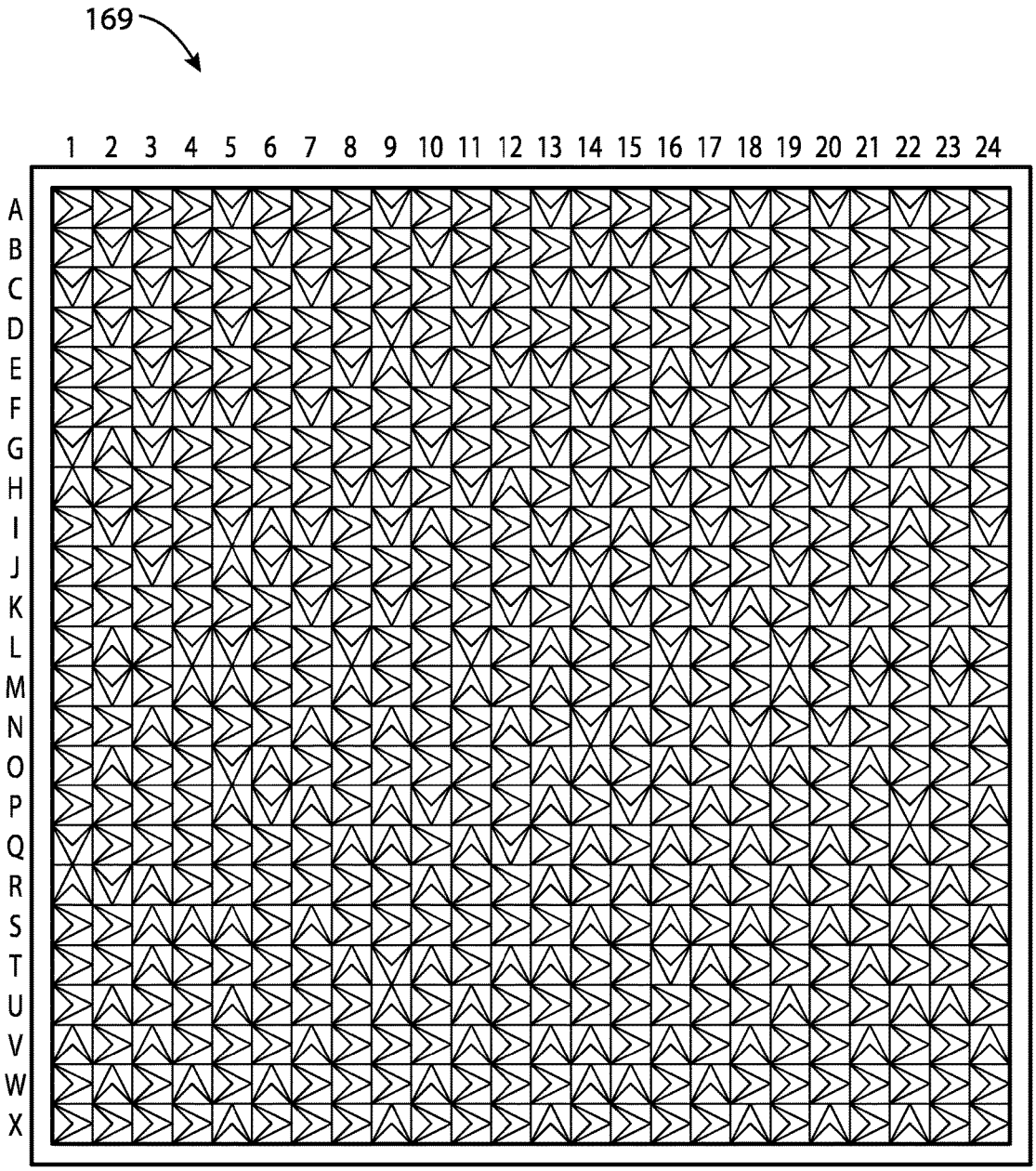
FIG. 8J illustrates a schematic plan view of an acoustic panel 169.

With these design parameters in mind, a variety of panels may be designed to take advantage of the present invention. The panels depicted in FIGS. 8A through 8J provide examples of potential designs that may be selected among other potential designs to achieve the results sought by the present invention. In particular, panel 160 (depicted in FIG. 8A) illustrates one potential design for a panel having a generally outward radiating directionality. FIG. 8B is a schematic plan view of an acoustic panel 161, which illustrates one potential design for a panel having a generally inward radiating directionality. FIG. 8C illustrates a schematic plan view of an acoustic panel 162, which illustrates one potential design for a panel having an upward predetermined, generally desired direction. FIG. 8D illustrates a schematic plan view of an acoustic panel 163, which illustrates one potential design for a panel having a downward predetermined, generally desired direction. FIG. 8E illustrates a schematic plan view of an acoustic panel 164, which illustrates one potential design for a panel having a left-upward predetermined, generally desired direction. FIG. 8F illustrates a schematic plan view of an acoustic panel 165, which illustrates one potential design for a panel having a right-upward predetermined, generally desired direction. FIG. 8G illustrates a schematic plan view of an acoustic panel 166, which illustrates one potential design for a panel having a right-downward predetermined, generally desired direction. FIG. 8H illustrates a schematic plan view of an acoustic panel 167, which illustrates one potential design for a panel having a left-downward predetermined, generally desired direction. FIG. 8I illustrates a schematic plan view of an acoustic panel 168, which illustrates one potential design for a panel having a leftward predetermined, generally desired direction. FIG. 8J illustrates a schematic plan view of an acoustic panel 169, which illustrates one potential design for a panel having a rightward predetermined, generally desired direction.

By deploying two or more acoustic panels 100 in an interior room a system for improving the acoustics of that interior room may be provided. The first acoustic panel may have a predetermined, generally desired direction away from the listening zone of the interior room. And that predetermined, generally desired direction of the first acoustic panel may further be toward one of the one or more dead zones in the interior room. The first acoustic panel may alternatively be designed to generally direct sound toward a second acoustic panel with that second panel in turn generally directing sound either toward a dead zone, away from the listening zone, or both. The second panel could also generally direct the sound waves to yet another, third acoustic panel.

It is generally preferred in deploying acoustic panels 100 that no two identical panels are placed side by side. It is also generally preferred that a left-directing panel not be placed to the adjacent right of a right-directing panel. Similarly, it is generally preferred that an upward-directing panel not be placed on the same wall of an interior space adjacent to and below a downward-directing panel. It is further preferred that panels 100 not be placed near the intersection of two walls of the interior space such that the predetermined, generally desired direction of panel would direct the sound toward the wall perpendicular to the wall on which the panel is mounted.

The foregoing system for improving the acoustics of that interior room comprising two or more acoustic panels 100 may be implemented by a method of installing a first acoustic panel $\mathbf{100}_a$ and a second acoustic panel $\mathbf{100}_b$. These panels $\mathbf{100}_a$ and $\mathbf{100}_b$ may be further adjusted such that the sound waves that reach the panel $\mathbf{100}_a$ are at least partially redirected to reach panel $\mathbf{100}_b$ while providing pseudo-chaotic differentiality.

The foregoing description and drawings merely explain and illustrate the invention and the invention is not limited thereto. While the specification in this invention is described in relation to certain implementation or embodiments, many details are set forth for the purpose of illustration. Thus, the foregoing merely illustrates the principles of the invention. For example, the invention may have other specific forms without departing from its spirit or essential characteristic. The described arrangements are illustrative and not restrictive. To those skilled in the art, the invention is susceptible to additional implementations or embodiments and certain of these details described in this application may be varied considerably without departing from the basic principles of the invention. It will thus be appreciated that those skilled in the art will be able to devise various arrangements, which, although not explicitly described or shown herein, embody the principles of the invention and, thus, are within its scope and spirit. All patents, patent application publications, and other publications are incorporated by reference in their entirety.

What is claimed is:

1. An acoustic panel for use in an interior space, the interior space having a listening zone and sound waves that reach the acoustic panel, the acoustic panel comprising:

a substrate including a face; and a plurality of nodules affixed to the face of the substrate wherein each nodule has a width and a substantially right triangular shape across the entire width with a first leg of the right triangular shape substantially perpendicular to the substrate, a base of the right triangular shape substantially parallel to the substrate and a hypotenuse comprising a flat surface, the first leg of each nodule having a height that is substantially less than a length of a quarter wave formed in the interior space by a lower frequency signal, wherein each of the nodules are oriented on the face of the substrate such that the hypotenuse slopes right, left, down or up as determined for each nodule by a predetermined, generally desired direction for redirecting the sound while providing fractal-chaotic differentiality.

2. The acoustic panel of claim 1 further comprising a sound absorption layer, the sound absorption layer being located on top of substantially all of the plurality of nodules.

3. The acoustic panel of claim 2 wherein the nodules are made of wood.

4. The acoustic panel of claim 3 further comprising a frame configured to receive the substrate, sound absorption layer, and the plurality of nodules within the three-dimensional area circumscribed by the frame.

5. The acoustic panel of claim 4 further comprising a fabric sheet wrapped over the frame.

6. The acoustic panel of claim 5 further comprising a hanger operably connected to the substrate, the hanger being configured to support the acoustic panel on a pre-existing surface of the interior space wherein the hanger is physically connected to the frame.

7. The acoustic panel of claim 2 wherein the sound absorption layer is less than about 0.5 inches thick.

8. The acoustic panel of claim 7 further comprising a frame configured to receive the substrate, sound absorption layer, and the plurality of nodules within the three-dimensional area circumscribed by the frame.

9. The acoustic panel of claim 2 wherein the sound absorption layer is formed of natural fibers.

10. The acoustic panel of claim 2 further comprising a fabric sheet wherein the fabric sheet is acoustically transparent.

11. The acoustic panel of claim 1 further comprising a frame configured to receive the substrate and the plurality of nodules within the area circumscribed by the frame.

12. A system for improving the acoustics of an interior room, the interior room having a listening zone, one or more dead zones and a source of sounds, the system comprising:

a first acoustic panel, the first acoustic panel having a first substrate including a face and a first plurality of nodules affixed to the face of the first substrate wherein each nodule has a width and a substantially right triangular shape across the entire width with a first leg of the right triangular shape substantially perpendicular to the first substrate, a base of the right triangular shape substantially parallel to the first substrate and a hypotenuse comprising a flat surface, the first leg of each nodule having a height that is substantially less than a length of a quarter wave formed in the interior space by a lower frequency signal, wherein each of the nodules are oriented on the face of the first substrate such that the hypotenuse slopes right, left, down or up as determined for each nodule by a predetermined, generally desired direction for redirecting the sound while providing fractal-chaotic differentiality; and a second acoustic panel, the second acoustic panel having a second substrate including a face and a second plurality of nodules affixed to the face of the second substrate wherein each nodule has a width and a substantially right triangular shape across the entire width with a first leg of the right triangular shape substantially perpendicular to the second substrate, a base of the right triangular shape substantially parallel to the first substrate and a hypotenuse comprising a flat surface, the first leg of each nodule having a height that is substantially less than a length of a quarter wave formed in the interior space by a lower frequency signal, wherein each of the nodules are oriented on the face of the second substrate such that the hypotenuse slopes right, left, down or up as determined for each nodule by a predetermined, generally desired direction for redirecting the sound while providing fractal-chaotic differentiality.

13. The system of claim 12 wherein the predetermined, generally desired direction for the first acoustic panel is away from the listening zone.

14. The system of claim 13 wherein the predetermined, generally desired direction for the first acoustic panel is also toward a first one of the one or more dead zones.

15. The system of claim 13 wherein the predetermined, generally desired direction for the second acoustic panel is generally toward a second one of the one or more dead zones.

16. The system of claim 12 wherein the predetermined, generally desired direction for the first acoustic panel is directed generally toward the second acoustic panel.

17. The system of claim 16 further including a third acoustic panel wherein the predetermined, generally desired direction for the second acoustic panel is directed generally toward the third acoustic panel.

18. A method of improving the acoustics of an interior room, the interior room having a listening zone, one or more dead zones and a source of sounds, the method comprising:

installing a first acoustic panel having a first substrate including a face and a first plurality of nodules affixed to the face of the first substrate wherein each nodule has a width and a substantially right triangular shape across the entire width with a first leg of the right triangular shape substantially perpendicular to the first substrate, a base of the right triangular shape substantially parallel to the first substrate and a hypotenuse comprising a flat surface, the first leg of each nodule having a height that is substantially less than a length of a quarter wave formed in the interior space by a lower frequency signal, wherein each of the nodules are oriented on the face of the first substrate such that the hypotenuse slopes right, left, down or up as determined for each nodule by a predetermined, generally desired direction for redirecting the sound while providing fractal-chaotic differentiality; and installing a second acoustic panel, the second acoustic panel having a second substrate including a face and a second plurality of nodules affixed to the face of the second substrate wherein each nodule has a width and a substantially right triangular shape across the entire width with a first leg of the right triangular shape substantially perpendicular to the second substrate, a base of the right triangular shape substantially parallel to the first substrate and a hypotenuse comprising a flat surface, the first leg of each nodule having a height that is substantially less than a length of a quarter wave formed in the interior space by a lower frequency signal, wherein each of the nodules are oriented on the face of the second substrate such that the hypotenuse slopes right, left, down or up as determined for each nodule by a predetermined, generally desired direction for redirecting the sound while providing fractal-chaotic differentiality.

19. The method of claim 18 further comprising adjusting one or both of the first and second acoustic panels such that the sound waves that reach the first acoustic panel are at least partially redirected to reach the second acoustic panel while providing pseudo-chaotic differentiality.

* * * * *